United States Patent [19]

Rybczyk

[11] 4,127,065

[45] Nov. 28, 1978

[54] ENCODING PRINTING DEVICE

[75] Inventor: Joseph A. Rybczyk, Levittown, Pa.

[73] Assignee: National Computer Systems, Inc., Minneapolis, Minn.

[21] Appl. No.: 746,198

[22] Filed: Nov. 30, 1976

[51] Int. Cl.[2] ..... B41J 1/20

[52] U.S. Cl. ..... 101/111; 101/93.14

[58] Field of Search ..... 101/45, 56, 111, 368, 101/93.14, 93.13, 105, 72–84, 99

[56] References Cited

U.S. PATENT DOCUMENTS

| | | | |
|---|---|---|---|
| 1,645,267 | 10/1927 | Walker | 101/111 |
| 2,096,340 | 10/1937 | Richeson | 101/111 |
| 3,012,499 | 12/1961 | Amada | 101/93.14 |
| 3,159,101 | 12/1964 | Deickan | 101/111 |
| 3,274,607 | 9/1966 | Muchon et al. | 101/111 X |
| 3,338,160 | 8/1967 | Heil | 101/99 |
| 3,608,481 | 9/1971 | Price et al. | 101/108 |
| 3,665,850 | 5/1972 | Berger et al. | 101/93.14 |
| 3,774,532 | 11/1973 | McKay | 101/111 |
| 3,968,745 | 7/1976 | Hamisch | 101/111 |
| 3,972,281 | 8/1976 | Sams | 101/110 |

*Primary Examiner*—Edward M. Coven

*Attorney, Agent, or Firm*—Dann, Dorfman, Herrell and Skillman

[57] ABSTRACT

A frame attachable to the numbering shaft of a conventional printing press supports and guides belts bearing print elements side-by-side across a printing head such that the belt paths define parallel columns and drive and indexing means position the belts such that print elements fall in selected rows to define at least one predetermined code pattern which prints a machine readable code.

44 Claims, 20 Drawing Figures

FIG. 6
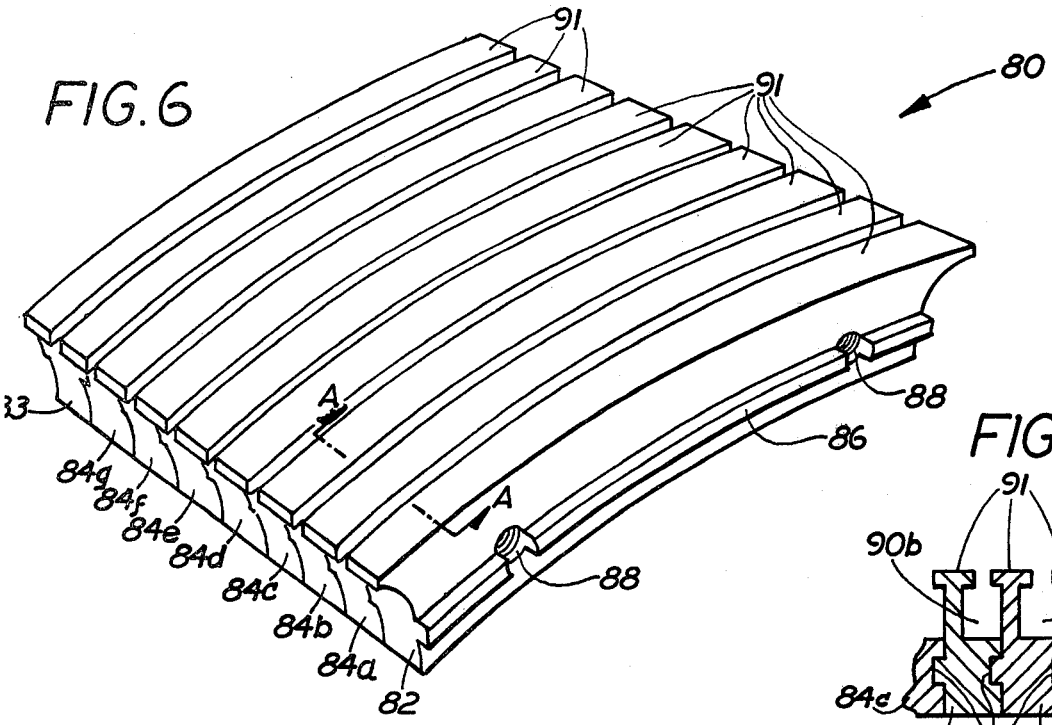
FIG. 6A
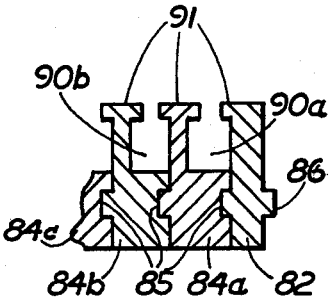
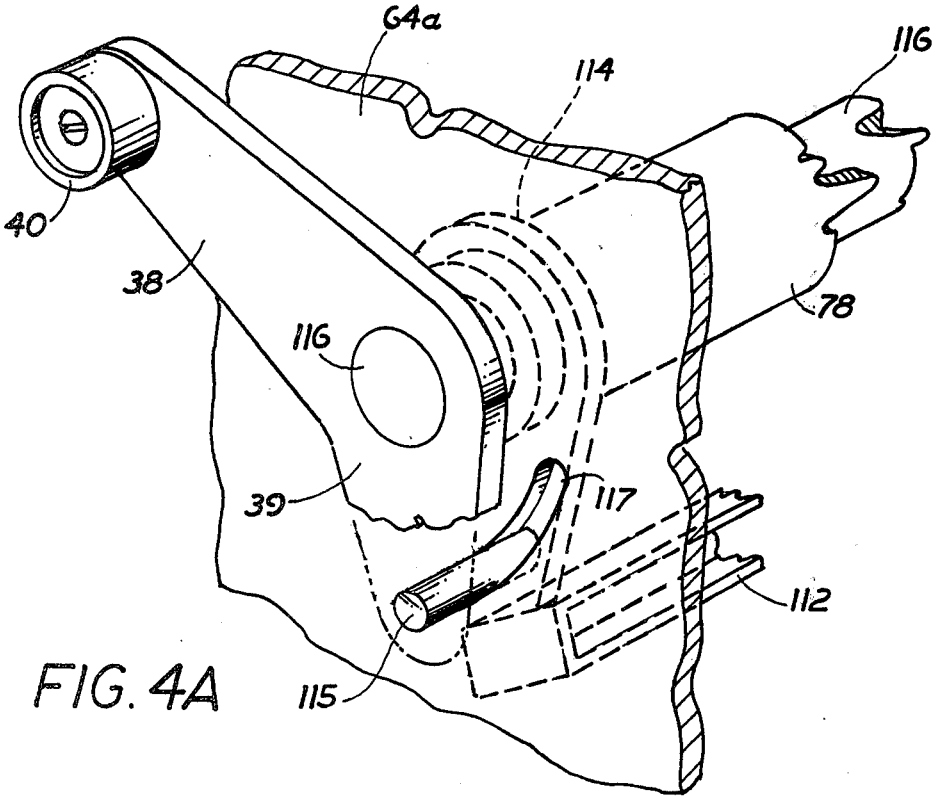
FIG. 4A

ENCODING PRINTING DEVICE

The present invention concerns an encoding printing device which is specially adapted for use on a printing press. The present invention also concerns the method of encoding using this device or other devices using similar principles.

There is a need for an encoding printing device which can identify consecutively printed sheets to an optical reading device. There is a particular need for a device which presents a matrix of encoding characters or marks which enables a known type of scanning code reader, for example, to automatically read a document or label, or the like, and to identify the number which is encoded on it. In the prior art printers for printing a fixed pattern have been known, and a line encoder for printing a variable pattern has been known. However, such an encoder capable of simultaneously printing the whole code matrix patterns, and particularly a continuing sequence of variable matrix patterns to both identify and distinguish documents, one from another, has not been known.

The present invention provides an encoding printing device which is capable of changing its code indication between impressions. This can be done even with high speed printing and will produce a matrix of marks which is readily optically machine readable. In some cases it is desirable to employ two encoding printing devices which alternate in printing, in which event a skip between the numbers represented by each of the encoding devices is needed, whereby one printer will print even numbers and the other odd. The present invention makes such an arrangement possible.

In the prior art, in the course of printing forms that are to be machine readable, such as test answer sheets, inventory forms and the like, it has become customary to provide sometimes for sequential numbering of the forms. Frequently this is done using a code pattern which is machine readable. In doing this identification markings are placed in a code box often placed along the upper margin of the sheet. This code box has provided both visually readable information and marking positions for placing vertical, bar-type marks. While the marking can be done by hand using a pencil in the same manner as the sheets themselves are marked, in the prior art a printer has been devised by Optical Scanning Corporation of Newtown, Pennsylvania, assignee of this application, for marking these boxes a column at a time. This device provides a line of individual aligned bar print elements side-by-side in a line along the width of the bars, each bar preferably corresponding in size to the marking spaces in the box. The print elements are individually driven by solenoid actuators against a typewriter ribbon, or the like, to make marks at these selected positions as the form is moved past and generally perpendicular to the line. In order to operate this device, however, it has been necessary to provide sophisticated logic control circuits to properly align the sheets in position for marking and then to actuate the code printer at each successive column. It has not been possible to accomplish this type of marking or identification of the test sheets in conjunction with a regular printing press. Instead, the marking has been done on sheets after they have been printed. In some cases, the sheets were serially numbered by printing the arabic digits and then the same encoded number was printed on the sheet. In such event, any error or discrepency in the numbering from the preprinted numbering would necessitate the discard of the whole set of the printed forms. If the numbering had to be printed front and back, the opportunity for such errors was multiplied. Furthermore, there prior art encoding printers were of necessity separate from the printing presses and therefore constituted an entirely separate step of printing in addition to the steps performed simultaneously or sequentially on the printing press. Furthermore, the device of the prior art was complicated, involved both electronic and mechanical parts, and was frequently subject to malfunction.

In accordance with the present invention the same type of encoding is achieved using a device which is entirely mechanical, relatively very simple and employs mechanisms which are similar to those used on conventional numbering machines and known to be subject to little operational difficulty. Furthermore, the encoding printing device of the present invention is provided as an attachment to a printing press so that the printing of the encoding can be done in the course of other printing. The numbering can easily be kept in sequence and there is no chance for sequential pages to stick together or other causes of error to arise. Furthermore, conventional techniques may be used for reversing the sheet to print on both sides so that in a single run through the printing press proper encoding can be done on both side of the form. Because the structure of the encoding printing device is simple, it is also easily maintained.

More particularly, the present invention concerns an encoding printing device for printing, in sequence, related but different indicia in association with appropriate printing apparatus. A support frame for the device is attachable to printing apparatus, in which material to be printed is fed, in such a way as to provide requisite movement of the encoding device and printing apparatus to effect sequential printing by the encoding device. A plurality of continuous flexible belts are arranged side-by-side relative to the support frame with each belt providing on its outside surface at least one print element capable of producing a printed mark. Each belt also provides drive engagable means accessible from inside the belt for positively engaging and moving each belt. Individual drive and indexing means for each belt are supported on the frame, positioned to engage the drive engagable means of its associated belt to move the belt around a path defined by guide means. A printing head on the support frame with the belts provides support for all of the belts over a predetermined printing area in opposition to printing pressures on the respective print elements during printing and engages the respective belts within that area to provide guides to maintain the respective belts and their print elements in predetermined column locations constituting common rows across the belts.

Preferably, the encoding printing device has a drive means including rotatable drive elements coaxially aligned and engaged with the drive engagable means of their associated belts. Also preferably each belt is provided with a plurality of path defining guide means corresponding ones of which are aligned in side-by-side positions on the support frame and the guide means, drive means and printing head define path shape, and support the belts generally parallel to and adjacent to one another.

The present invention also contemplates a method of arranging mark printing elements in parallel columns so that marks in various rows permit printing a matrix of marks capable of being read by a mark reader and in successive steps changing the position of the mark printing elements in accordance with a predetermined pattern so that successive printings will present different patterns of marks on the matrix. This may be done so that mark positions represent a decimal system with ten mark positions in each column and the various columns representing the respective decimal places. Such an arrangement contemplates an arrangement whereby when marks reach the end of one column, a mark will appear or advance in an adjacent column.

For better understanding of the present invention reference is made to the accompanying drawings, in which:

FIG. 4A is a much enlarged perspective partial view showing details of connection between the operating arm and drive pawl housing;

FIG. 6 is a much enlarged perspective view detail of the printing head portion of the frame shown in perspective;

FIG. 6A is a partial sectional view taken along line A—A of FIG. 6;

Figure 1:
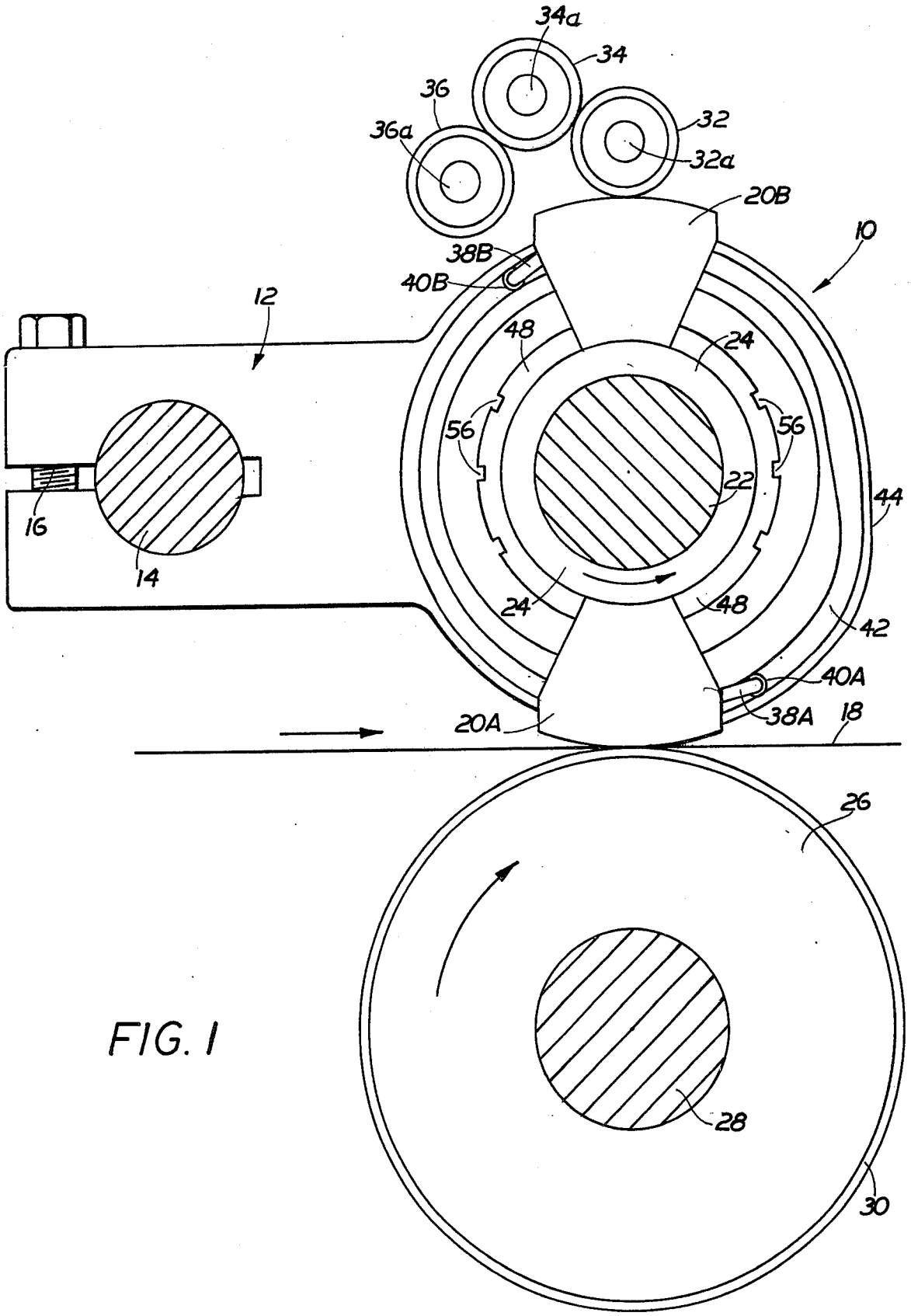
FIG. 1 shows somewhat diagrammatically a pair of encoding printing devices in accordance with the present invention installed on a press for printing forms on a continuous paper web.

Referring first to FIG. 1, a preferred arrangement for use of the encoding printing devices of the present invention on a continuous printing press which generates a continuous web of printed forms, which will later be cut apart, is shown. Such presses today are commonly composed of functionally modular units called "towers" placed together in a predetermined sequence connected to a common drive so that they characteristically operate at a common speed. Such a press accomplished all functions in sequence in one pass through the press, using a continuous web. One side of the form is printed at a printing tower. It may be numerically numbered at a numbering tower, number encoded using the device of the present invention at another numbering tower, turned over on its other side at a tower for that purpose, similarly processed on its second side at three successive towers, and, finally, cut into sheets at a cutting tower. The printed matter produced on the printing press may be of any type, but particularly compatible with the encoding printing device of the present invention are machine readable forms to be read by optical scanning mark detection devices also useful to read the coding printed by the encoding printing device. For example, forms typical of this type are forms for use in answering tests on which lines are marked to indicate answers and which may be scored by known scoring devices or inventory control devices where data is entered onto the sheets by marking a line or bar in selected specific positions indicated for that purpose. Usually, a vertical mark on such a form made with a pencil, for example, can later be read by a scanning machine which is position sensitive so that a mark or the absence of a mark in a given position represents a given piece of data. The coding produced by the encoding printing device of the present invention provides data in a similar form readable in the same matter with the same machine.

The encoding printing machine of the present invention is capable of printing machine readable marks such as those which will be selectively placed on a sheet to enter data. Marks printed by the encoding printing device provide identification similar to numbering but in a coded form which is readable by the same scanner machine which is used to read the data printed onto the forms. Whether marked by hand or printed on the sheet, such marks can be automatically read in the same way by the scanner.

As will be discussed below in connection with FIG. 15, the print code is comprised of a matrix in which mark positions in a predetermined number of columns and rows are sequentially marked in different patterns identifiable as representing previously determined numbers. In a preferred code, only one mark can occur in a given column at a time, the row positions of the marks being changed. These row positions are representative of of the digtis, 0 through 9 in sequence top to bottom, the represented number depending on the row position of the printed mark. A preferred code employs as many columns as digits in the largest number to be represented by the code. Thus, an eight column code can represent numbers from 0 up to 99,999,999. Of course, the coding need not be decimal, but such a decimal code employing sequential row positions to represent consecutive digits, provides the simplest means of illustrating how the encoding printing device operates.

Referring now to FIG. 1, there is represented a small part of a printing press, which, for example, might be a lithographic press used to print mark encoded business forms, and the like. The exact nature of the printing press as a whole is immaterial, and whether the product of the press is printed on a continuous web or individual sheets is of no importance. Neither is the location of the encoding printing head relative to the press and whether it is positioned to act before or after other printing on the sheet or web portion to which it applies its coding pattern. FIG. 1, shows somewhat schematically the functionally cooperating parts of one printing press tower, generally designated 10, for encoding the printing device. A cam arm 12 is supported on a cam shaft 14 which is fixed to the frame of the tower and hence provides a fixed reference to the printing press. Cam arm 12 is clamped by at least one clamp screw 16 against the cam shaft 14 and may be released and retightened to facilitate movement of the cam arm laterally of the press and of the continuous paper web 18. In this embodiment, two identical encoding printing devices, 20A and 20B, revolve about the numbering shaft 22 to which they are connected by a holding ring 24 which, like the cam arm 12, is laterally repositionable along the numbering shaft to adjust the lateral position at which the encoding printing devices will print on the web 18. The encoding printing devices 20A and 20B are positioned diametrically opposite one another so that they alternately contact web 18 when in the position shown for device 20A in the course of the counterclockwise rotation from the viewed direction. Opposed to the encoding printing devices 20A and 20B on the opposite side of web 18 is an impression cylinder 26 on shaft 28 having a resilient surface layer 30. Shaft 28 is driven at a speed which will give the surface of layer 30 on the impression cylinder, 26 which contacts the web 18, the same linear speed as the printing surface of the encoding printing device and the web 18 in this particular embodiment. The shafts are all preferably connected to a common drive to provide similar speeds for shafts 22 and 28 to provide similar surface speeds since the radii of the opposed surfaces contacting the web are the same, and the same as the linear speed of the web itself.

Inking roller 32 is part of a combination of conventional inking rollers 32, 34 and 36 supported respectively on shaft **32*a*, 34*a* and 36*a*, about which the rollers are free to rotate, all rotatably mounted on the same frame structure as cam arm 12 and numbering shaft 22. The inking rollers may be supplied ink in any conventional way by supply means (not shown) also supported on the same frame structures. Print elements ink in passing the inking roller 32 when approaching and passing through the position of encoding printing device 20B. The inked print elements print onto the moving web when the encoding printing device has moved into the position shown for encoding printing device 20A**.

Operating arms 38A and 38B are crank arms, whose function will hereafter be explained in greater detail, and whose reciprocating movement relative to the respective encoding printing devices 20A and 20B produces the sequence of movement needed to change the coding pattern. This reciprocal rotational movement of arms relative to devices 20A and 20B is accomplished by interaction with cam arm 12. More specifically, the encoding printing devices operating arms 38A and 38B, respectively, carry rollers 40A and 40B, both of which are engaged within cam groove 42 in cam arm 12. Cam groove 42 is formed in enlarged portion 44 of cam arm 12 which is open at its center to permit passage of numbering shaft 22. The action of cam groove 42 upon rollers 40A and 40B is to move arms 38A and 38B relative to their respective encoding printing devices, preferably just pass the printing position, in such manner as to change the coding to the next sequential position.

Consideration will now be given to the construction of the encoding printing device which is generally identified by the reference numbers 20 and 20' in FIGS. 2, 3, 4 and 14 which will be understood to correspond to either of the encoding printing devices 20A or 20B in FIG. 1. These encoding printing devices show operating arms 38 and cam engaging rollers 40 for operating the arms or a modified operating arm 38' and ball element 40' in the slightly modified encoding machine 20' of FIG. 14.

Figure 2:
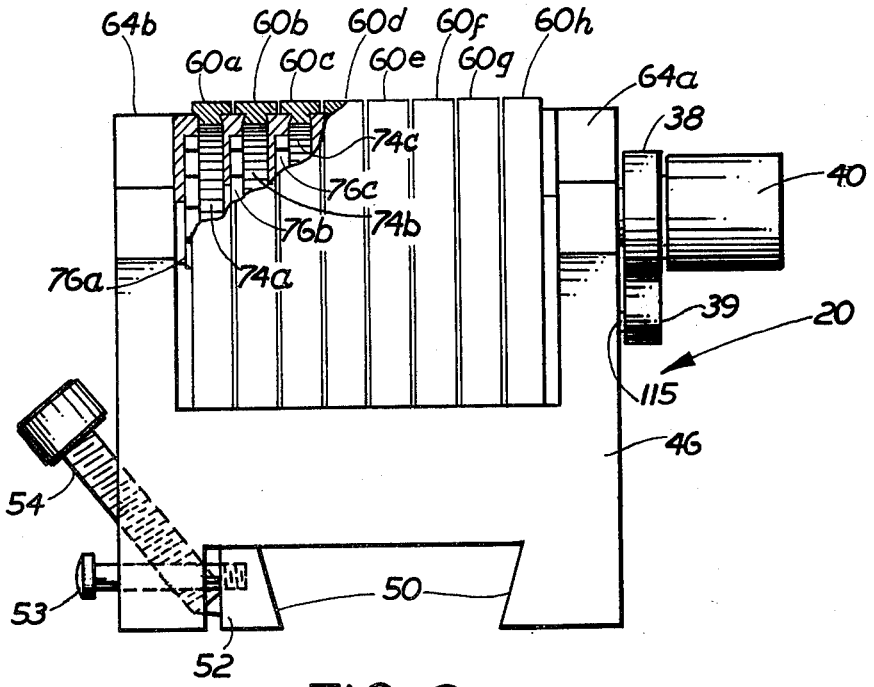
FIG. 2 is a front elevational view of an individual encoding printing device of the present invention.
Figure 3:
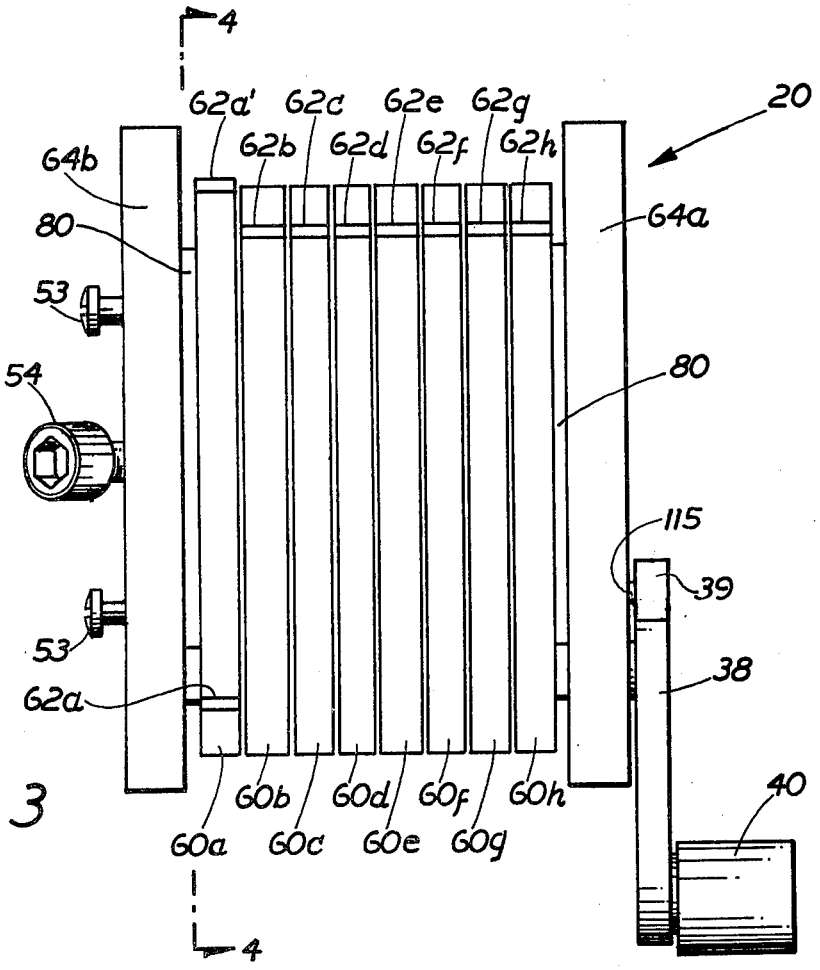
FIG. 3 is a top view looking down on the printing area of the encoding printing device of FIG. 1.
Figure 4:
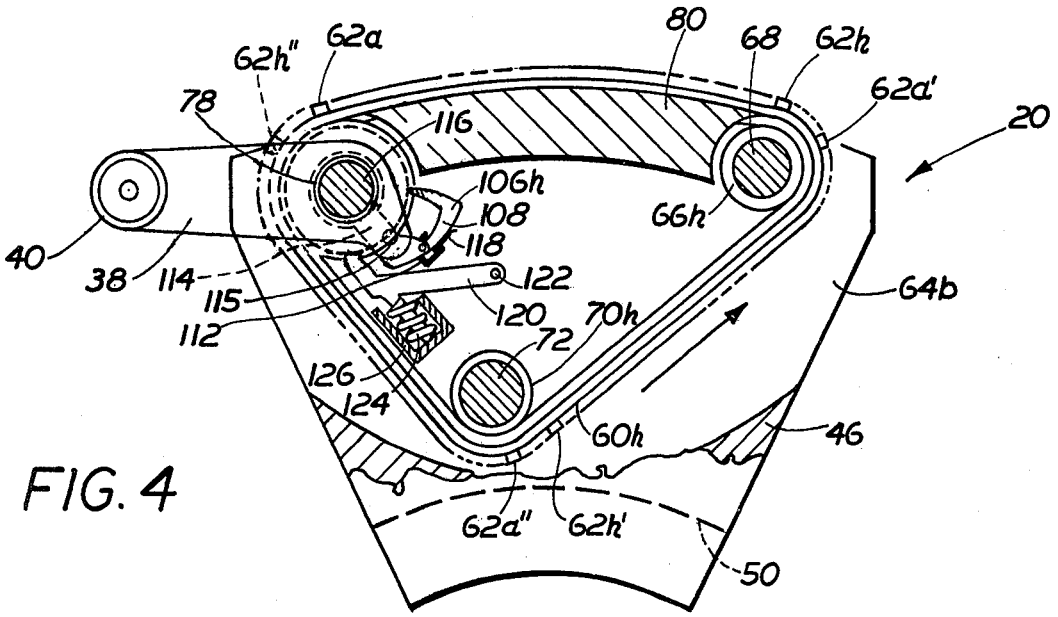
FIG. 4 is a side elevational view of the same encoding printing device from that side supporting the operating arm, with a portion of the frame structure broken away to show the internal structure.

Referring to FIGS. 2, 3 and 4, a housing or frame member 46 supplies the support for the movable and active elements of the encoding printing device and is the means of attachment of the encoding device to the holding ring 24 (See FIG. 1). Various means of attachment of the frame 46 to the holding ring are possible but in a preferred arrangement an interlocking dovetail or keystone device is employed. The outer portion of the holding ring to which the encoding printing device 20 is attached provides an outer rim 48 having an outwardly diverging keystone. As best seen in FIG. 2, an opposed and mating portion providing a dovetail slot 50 in the frame 46 cooperates with the dovetail rim 48. Preferably one wall of the slot 50 is movable to widen or narrow the slot to permit disengagement or engagement with the dovetail rim 48. The movable wall member 52 provides one wall of the slot and is supported on guide pins 53 penetrating the frame 46 through holes snugly engaging and supporting the pins and thereby guiding the movable wall member 52 portion along a predetermined path. The movable wall member 52 is capable of being moved and clamped in place by some conventional means such as clamp screw 54 extending through the frame 46 and bearing against that side of the movable wall member 52 opposite the dovetail slot. Rotation of clamp screw 54 in the proper direction to cause it to advance inwardly into the housing will urge the movable wall member 52 inwardly. Dimensions are selected to permit the width of the slot 50 to be sufficient to pass over the flange 48 and thereafter to permit movable member 52 to be tightened down when the frame 46 is in place over dovetail flange 48. When so tightened, the walls of the slot engage the outer wall of the rim flange 48. Of course, it will be understood that the slot 50 is curved to conform to the curvature of rim flange 48 as best seen in FIG. 4 where the upper bounds of the slot 50 is shown by a dashed line.

Referring now to the movable structure of the encoding printing devices, it will be observed that in the embodiment shown there are eight flexible belts **60*a*, 60*b*, 60*c*, 60*d*, 60*e*, 60*f*, 60*g* and 60*h* in an array best seen in FIGS. 2 and 3. Each of the belts carries at least one print element 62*a*, 62*b*, 62*c*, 62*d*, 62*e*, 62*f*, 62*g* and 62*h*. The type of print elements employed in the embodiment shown are simply straight lines or bars. In the embodiment represented, there are three print elements per belt as can be seen in FIG. 4. Second and third print elements on the same belt are identified with the same numbers as the first with the addition of a prime and double prime thereto, respectively. Specifically in FIG. 4 the belt closest to the operating arm 38 is 60*h* which carries raised print elements 62*h*, 62*h'* and 62*h''***. In the position of the belts shown in FIG. 3, the only other print elements visible in any views are elements 62*a*, 62*a*' and 62*a*" seen in FIG. 4 on belt 60*a*.

As can be best seen in FIGS. 2 and 3, the frame provides a wide channel between widely separated parallel supporting walls 64*a* and 64*b*, between which the supports for the belts and the drives for the belts are located. As can be best seen in FIG. 4 the supports and drives for the belts define a roughly triangular belt path with each of the belt paths being essentially the same size and shape and each belt essentially parallel to the other belts between the parallel support walls 64*a* and 64*b*. The supports and drives provide the function of defining the direction of the belt path as well as supporting the belts. The supports are provided by coaxially aligned belt transport pulleys 66*a*, 66*b*, 66*c*, 66*d*, 66*e*, 66*f*, 66*g* and 66*h* on a common shaft 68 and coaxially aligned belt take up pulleys 70*a*, 70*b*, 70*c*, 70*d*, 70*e*, 70*f*, 70*g* and 70*h* on a common shaft 72. The shafts 68 and 72 are supported on and extend between side walls 64*a* and 64*b*. The pulleys in each case are individually rotatable relative to their supporting shafts and may be provided with a sleeve bearing surface or other type of bearing arrangement, as desired. The individual drives as most clearly seen in FIG. 5 include typically a gear portion 74*a*, 74*b*, 74*c*, 74*d*, 74*e*, 74*f*, 74*g* and 74*g* made integral with, or attached to, a ratchet portion 76*a*, 76*b*, 76*c*, 76*d*, 76*e*, 76*f*, 76*g* and 76*h* and mounted on shaft 78. The individual combination members 74 and 76 rotate together as units relative to shaft 78 and separately from one another, in response to the manner in which the ratchets 76 are driven. A discussion of the preferred drive system for use with the ratchet wheels 76 will be deferred pending further elaboration on the printing head and guide structure 80 for the belts 60.

A preferred version of a printing head is shown in FIG. 6 in perspective with the sectional detail of FIG. 6A added to show its construction. Printing head 80 can be made of end pieces 82 and 83, and identical intermediate pieces 84*a*, 84*b*, 84*c*, 84*d*, 84*e*, 84*f* and 84*g*. As seen in FIG. 6A the bottom portions have an interfitting mortise and tenon (key) joint extending lengthwise over their entire lengths to add to the precision of the structure in assembly. T-shaped upward extensions to the intermediate pieces with inverted L-shaped extensions on the end pieces together form the belt retaining slots. As shown, there may also be outward extending tenons 86 on pieces 82 and 83 on each end of the head assembly 80 which fit mortise slots in the parallel walls 64*a* and 64*b*. The mortise and tenon construction aids precision in location of pieces in relation to one another, and supporting bolts extend through the entire assembly head 80 and through parallel walls 64*a* and 64*b* through holes 88 to hold the printing head 80 together and relative to the frame 46. The head thus connected to the frame provides rigid overall structure. The nesting of the pieces together forms inverted T-shaped slots 90*a*, 90*b*, 90*c*, 90*d*, 90*e*, 90*f*, 90*g* and 90*h*, partially closed by overlying retention rails 91 which are designed to retain and guide the respective belts. Since the belts are intended to be retained, a head so designed must be disassembled to put the belts in place.

As indicated above, the printing head is a precision structure and the key members aid quick and precise alignment. Although it is not shown, it will be understood, that in a preferred embodiment, one wall 64 of the frame 46 is preferably removable to aid in removal of the head. By using an optional construction whereby the retention rails are omitted belt removal can be accomplished without the need of a segmented head. This alternative permits a one piece printing head without keys and a removable side to the frame.

Figure 7:
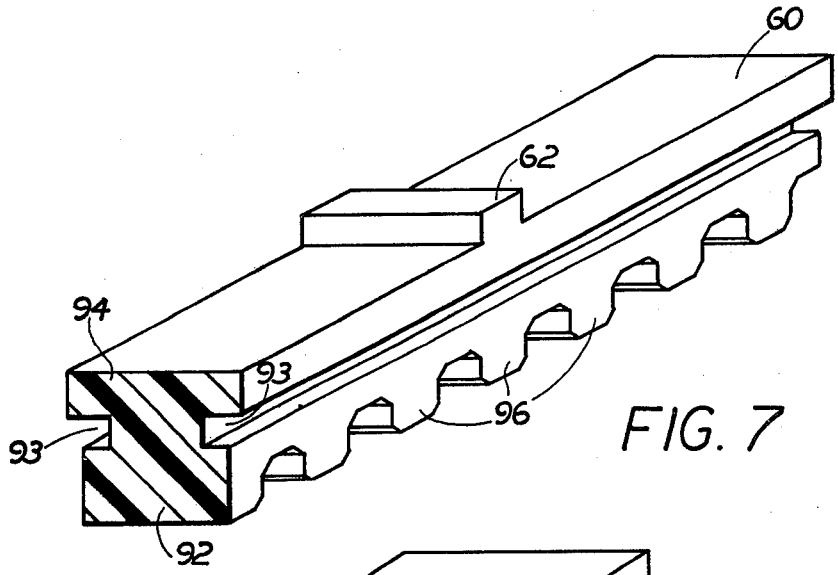
FIG. 7 is a further enlarged perspective view detail showing a portion of a single printing belt of one preferred variety intended for cooperation with the printing head structure of FIG. 6.

FIG. 7 shows a portion of one of the flexible belts 60 bearing a print element or bar 62. It will be observed that the lower portion 92 of this belt is T-shaped in cross-section to fit within one of the T-shaped slots 90 and be retained therein by retention rails 91. In use, the belt is guided by containing portion 92 within the slot 90 and the retention rails 91 within opposed grooves 93 retain the belt in the slot 90. In addition to closely engaging the T-shaped portion of the belt 92 to hold it against lateral motion and very positively position it laterally, the printing head 80 provides pressure surfaces against which each belt may rest. The bottom of each T-shaped slot 90 supports its belt over the entire length of the section within the printing matrix area and gives firm backing to each print element in printing position no matter what positions are selected for them in a given printing.

As seen in FIG. 4, the printing head 80 is curved and the curvature is in conformance with the appropriate circumferential circular arc drawn from the radius at the encoding printing device supported on the numbering shaft, as can be seen in FIG. 1. The surfaces of the print elements may incorporate a slight curvature, but if they do it is a relatively insignificant amount due to their narrowness in the direction of rotation. The T-shaped slot in printing head 80 acts essentially in the same way as with the belt of FIG. 8. Again opposed slots 93' receive retention rails 91 (FIG. 6) to retain the belt in the groove 90 (FIG. 6A).

Figure 5:
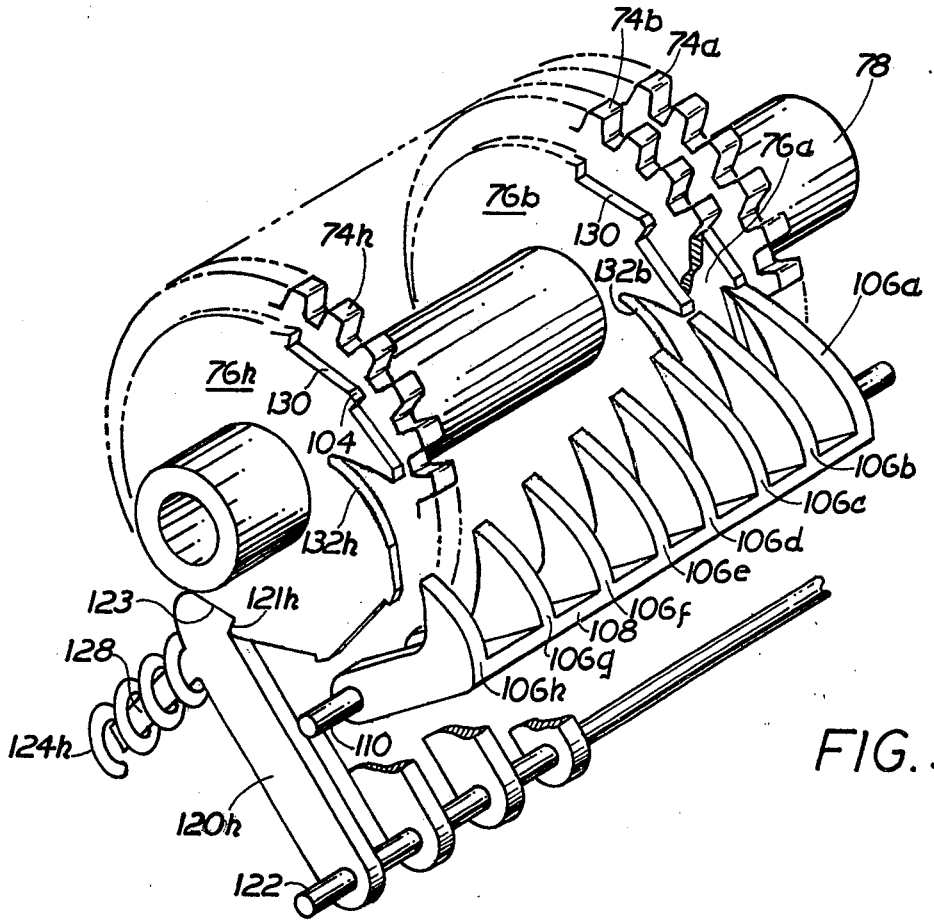
FIG. 5 is a perspective view of a drive and indexing means for the encoding printing device.

FIG. 5 shows a preferred drive mechanism having a series of gears 74*a* through 74*h*, of which only gears 74*a*, 74*b* and 74*h* are specifically shown. The teeth of these gears 74 engage the rack type teeth 96 such as provided on the flexible printing belt or FIG. 7. Made as an integral piece with each gear 74, or mechanically fixed to it, is a ratchet wheel 76 so that the two pieces rotate about bearing shaft 78 as a unit. The ratchet wheel 76 ordinarily under these circumstances is designed so that each of its 10 pawl 104 is positioned to receive its associated drive pawl 106 against a ratchet tooth shoulder to drive the ratchet counterclockwise as seen in FIGS. 4 and 5 whenever its cooperating pawl 106 moves upwardly or counterclockwise and extends in toward its ratchet wheel 76 far enough to make contact with a tooth.

In practice the pawls 106*a* through 106*h* are made in a unitary comb structure 108 with the individual pawl elements 106*a* through 106*h* decreasing in length toward their respective ratchet wheels. Consequently, when pawl 106*a* engages a tooth 104*a* of its ratchet wheel 76*a*, normally none of the other pawls will engage their respective ratchets. When pawls 106*b* engages its ratchet wheel 76*b*, normally none of the shorter pawls will engage their ratchets. Corresponding differences in pawl length exist down to the shortest pawl 106*h*. The pawl assembly 108 is pivotally supported on the rod 110, carried in a drive pawl housing 112 as seen in FIG. 4. Housing 112, in turn, is carried on a pair of yoke arms 114 respectively located just inside walls 64*a* and 64*b* and rotatably supported on hollow stationary bearing shaft 78 (see FIG. 4A). Shaft 116 is rotatably supported within hollow shaft 78 and is fixed directly to the operating arm 38 to which is fixed the roller 40. As best seen in FIG. 4A a pin 115 connects one yoke member 114 and the operating arm 38 through its extension 39. To permit this interconnection pin 115 passes through arcuate slot 117 in wall 64a which slot permits sufficient movement for the drive pawls to operate. As viewed in FIG. 4, when the cam track 42 causes roller 40 and the operating arm 38 to move downwardly or counterclockwise, the crank arm 39 and yoke 114 are moved upwardly. The drive pawl housing 112 is thereby moved upwardly carrying the pivot 110 and pawl comb assembly 108 upwardly. Leaf spring means 118 retained in the housing 112 serve to urge the pawl comb assembly 108 inwardly about pivot 110 toward respective ratchet wheels 76 whereby at least ratchet wheel 76a is engaged by pawl 106a.

FIGS. 4 and 5 also show retaining pawl means. Each of the ratchet wheels is provided with a retaining pawl 120a through 120h pivotally supported on a rod 122 which extends between the parallel sidewalls 64a and 64b. The retaining pawls 120a through 120h may be separately actuated by individual spring means 124a through 124h of the form shown in FIG. 5, for example. The spring means as shown in FIG. 4 must be supported on some support structure such as channel 126 affixed to the frame 46, for example, at walls 64a and 64b. Channel 126 retains individual springs 124 for each retaining pawl 120 to urge its pawl about its supporting pivot 122 toward its associated ratchet wheel. As shown in FIG. 5 a spring 124h, for example, surrounds an extension 128h on pawl 120h. The support for the springs could be simply a bar instead of channel 126 extending between the walls 64a and 64b, to which one end of the spring is fixed, with its other end bearing against the retaining pawl lever 120 to urge it toward ratchet-engaging position. Pawl shoulder 121h, for example, specifically engages a ratchet tooth 104 to effectively index the ratchet wheel 76h, its associated drive gear 74h, belt 60h, and its print elements 62h into a predetermined unique discrete position. If the pawl shoulder 121h does not engage tooth 104 immediately, rounded portion 123 engages a cam slope 130 and thereby drives the free ratchet wheel 76h backwards (clockwise) until shoulder 121h does engage. Other ratchet wheels and belts are indexed in the same way.

The ratchet wheel changes position in response to drive pawl engagement and movement. The drive pawls move as a unit in a counterclockwise direction and at least pawl 106a engages one of the teeth 104 on ratchet wheel 76a and moves it counterclockwise. During this process retaining pawl 120a and its spring 124a yield but stay in contact with the ratchet wheel 76a. Each ratchet wheel is free to rotate as its associated drive pawl engages and moves it independently of the other ratchet wheels. Assume that in a given application the purpose is to advance the belt 60a one position and to retain it in the proper indexed position. The pawl 106a will drive the ratchet wheel 76a probably slightly past the desired position. When drive pawl 106a is retracted, the restoring force of retaining pawl 120a is no longer opposed and, due to spring pressure on the cam slope 130 on the opposite side of the ratchet tooth 104, the retention pawl will cam the ratchet wheel to a position where the retention pawl cannot move further radially inward, at which point it engages one of the teeth 104 to hold it in a uniquely indexed position.

The purpose of the notches 132a through 132g will be understood in terms of the transfer or carry function. When the ratchet wheel 76a is about to be returned to its zero position, the notch 132a will appear opposite the pawl 106a. The notch is shaped so that no matter how far inwardly pawl 106a moves, it is still effective to drive the ratchet wheel. Functionally, when the pawl 106a is able to move further inwardly radially, drive pawl 106b is able to engage a tooth 104 on its ratchet wheel 76b and move its gear 74b and belt 60b and print element 62b one position. Of course, on the next step the notch 132a will have been moved out of range of pawl 106a so that pawl 106b and the other pawls cannot engage their respective ratchets. However, ten steps of ratchet wheel 76a will bring notch 132a again opposite drive pawl 106a and pawl 106b will then again be engaged and move its ratchet another step. This is repeated for 100 steps by ratchet wheel 76a, at which time the notches 132a and 132b both appear opposite their pawls, and pawls 106a and 106b are urged inwardly into their notches sufficiently far that pawl 106c will engage and drive its ratchet wheel 76c one step. The process continues down the line so that after ten steps of ratchet 106c notch 132c will be encountered simultaneously when notches 132a and 132b are encountered and pawl 106d can then engage and drive ratchet wheel 76d. The same procedure occurs such that, after ten steps of ratchet wheel 76d, pawl 106e will engage ratchet wheel 76e. After ten steps of ratchet wheel 76e, pawl 106f will engage and drive ratchet wheel 76f. After ten steps of ratchet wheel 76f, pawl 106g will engage and drive ratchet wheel 76g. After ten steps of ratchet wheel 76g, pawl 106h will engage and drive ratchet wheel 76h.

Of course, it is understood that other types of mechanisms are available, whereby drive with transfer essentially as described can be achieved by other means. However, the described apparatus is a preferred type for use with the present invention.

Figure 8:
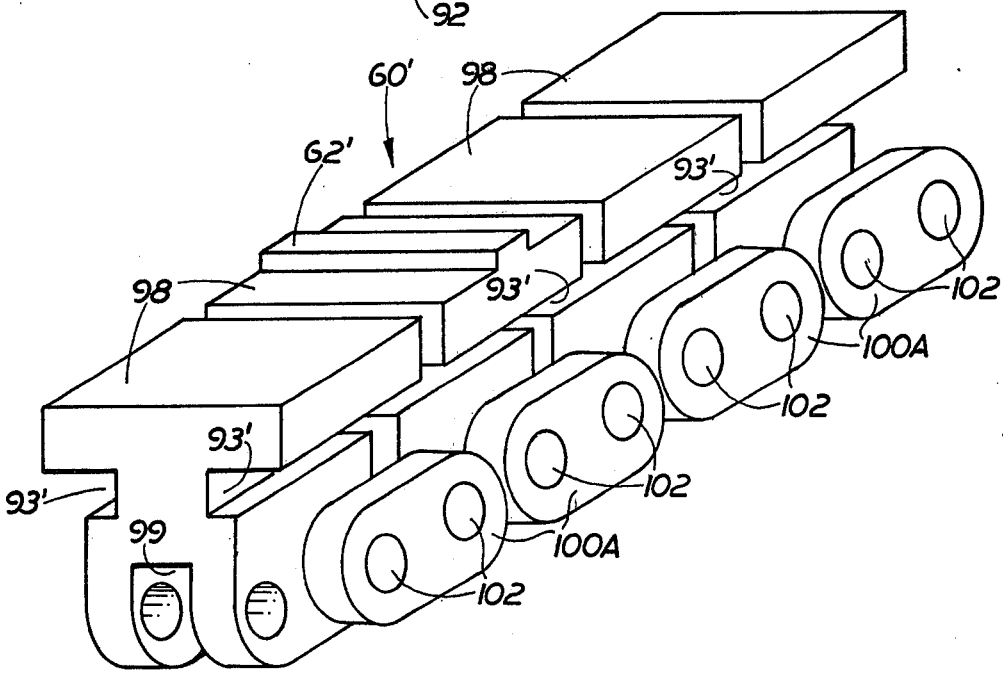
FIG. 8 is a view similar to FIG. 7 showing a modified type flexible printing belt also useful with the structure of FIG. 6.
Figures 9, 10A, 10B, 10C:
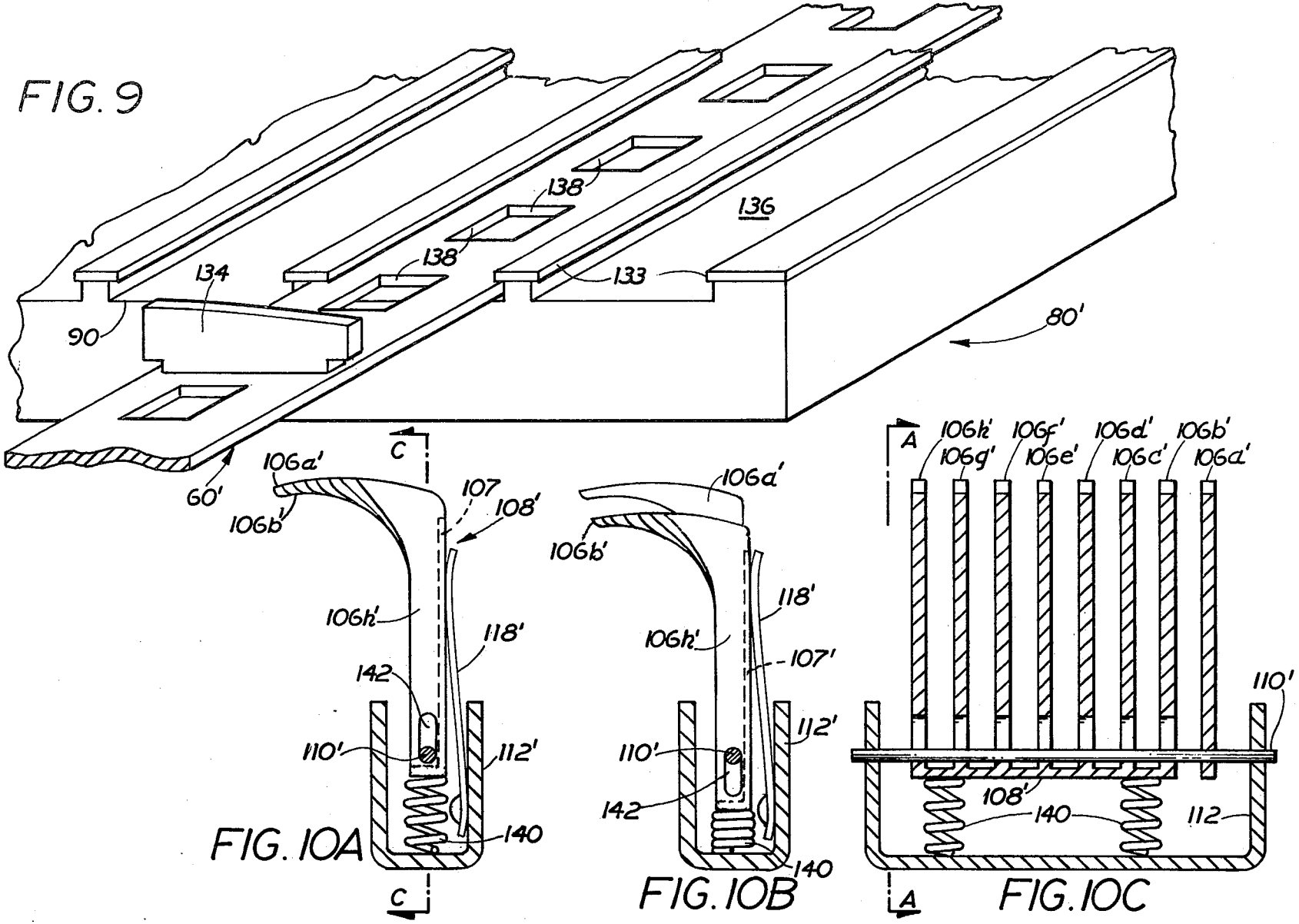
FIG. 9 is a similarly enlarged perspective view showing a portion of still another type of flexible printing belt and a portion of a suitable printing head structure designed to carry this type of belt.
FIG. 10A is an enlarged side view detail of a modified pawl arrangement in pre-engagement position.
FIG. 10B shows the same pawl arrangement in a position assumed after engagement of two of the pawls.
FIG. 10C is a sectional view taken along line C—C of FIG. 10A showing a back view of the same assembly of pawls in 1he FIG. 10A position.

Referring now to FIG. 9, an alternative belt structure to that shown in FIGS. 7 and 8, for use with a modified printing head 80' is illustrated. In this case the flexible belt of 60' is formed of continuous flexible sheet material in a ribbon or band closed on itself. While this belt could be of resinous material appropriately treated, it might better be a steel band, for example. The printing head 80' in this case instead of being made of modular pieces as illustrated in FIG. 6 is made of one piece appropriately curved as shown in FIG. 4 or flat as shown in FIG. 9 and provided with what may be milled guide grooves 90' serving in essentially the same way to contain and guide the belts 60'. However, the overall depth of the slots 90' may be greatly reduced. In this case, retention rails 133 are provided by strips which together with the groove, form a much flattened inverted T-shaped slot. The strip rails 133 may be held in place against the head by screws (not shown) or other means easily removed for removal of belts. Alternatively, if the belts are sufficiently flexible and resilient they may be deformed for insertion under the retention rails. As in the previous embodiment, the narrow retention rails 133 themselves do not provide the principal backup for the print elements 134 which are attached directly to the belt 60' with suitable insets to permit bypass of the retention rails 133, although the print elements 134 extend above the rails and effectively provide for full column width characters within each column. In fact, the print elements are advantageously made wider than the actual belt. The pressure from the printing operation is transmitted through the belt 60' principally to the base 136 of the channel 90'. The drive means is also modified in that, instead of providing a rack with projecting gear teeth, regular perforations 138 are provided to give positive interfitting engagement with the teeth of gear drive elements 74. If desired, the drive means may provide smaller teeth cooperating with smaller holes in the belt. Another obvious variation could be the use of a flat chain directly driven by a conventional sprocket. In any event, it will be clear that within the scope of the present invention wide variation on the structure of both belts and printing heads is possible.

Figure 11:
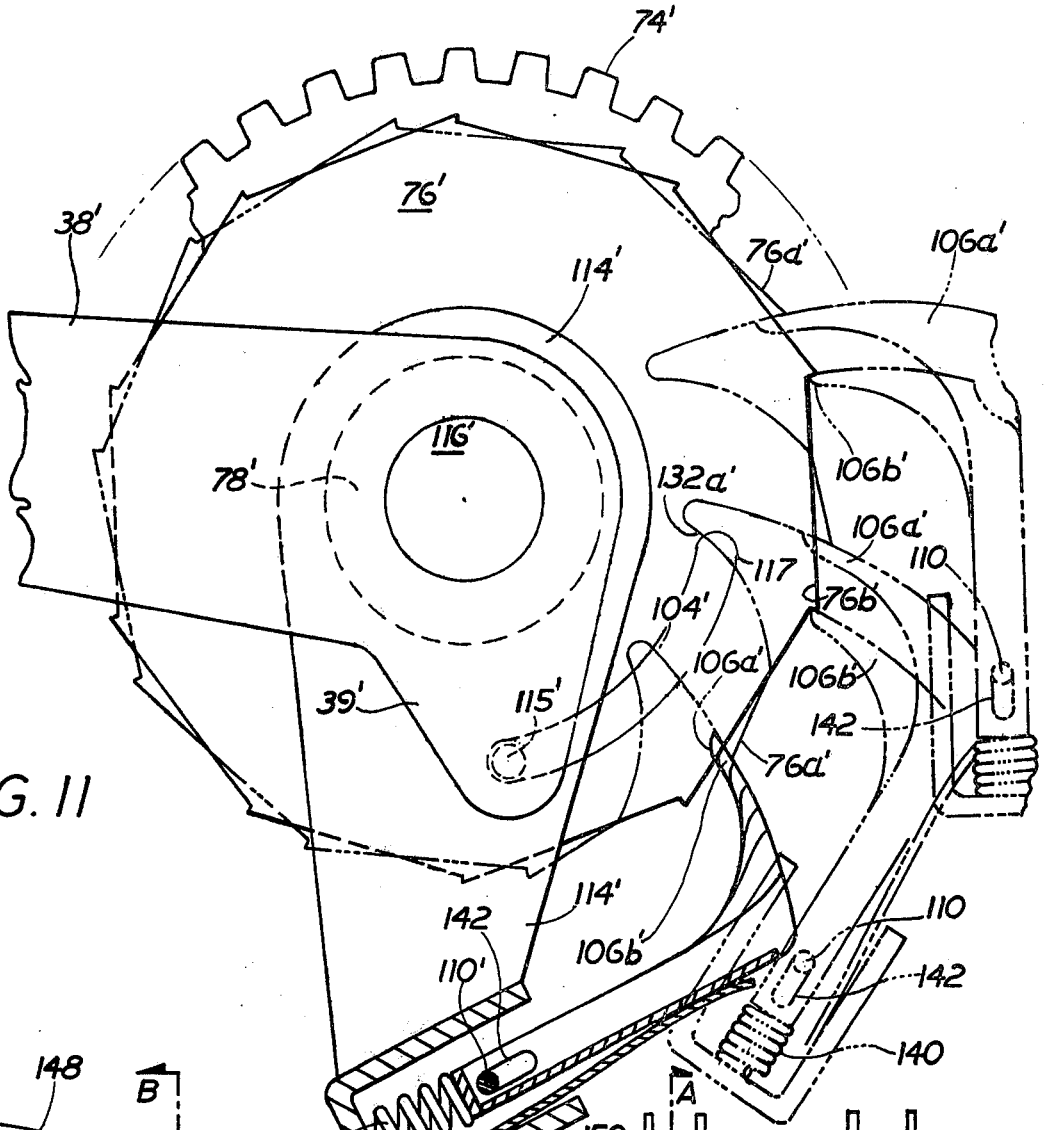
FIG. 11 is a diagrammatic view showing successive stages of operation of a device using the pawl assembly of FIGS. 10A, 10B and 10C.

Referring now to FIGS. 10A, 10B, and 10C in conjunction with FIG. 11 these drawings show a modified pawl construction whereby a built-in skip feature can be provided for the units digit belt. This will enable the units belt to move in two unit increments, such that the alternate use of two encoding printing devices as shown in FIG. 1 will permit the printing of consecutively numbered sheets. Thus, for example, if the encoding devices 20A print even numbers, the encoding devices 20B print odd numbers, and vice versa. In particular, the arrangement is such as that shown in FIG. 11. When the operating arm 38' is moved downward or counterclockwise about shaft 116' its extension 39' through pin 115' moves the yoke 114' and pawl housing 112' upwardly and counterclockwise as shown by the successive dash line positions of the pawls and pawl housing. Instead of making the pawls **106*a*' through 106*h*' having a unitary comb structure, like 108 of FIG. 5, a unitary comb structure 108' is provided only for pawls 106*b*' through 106*h*'. Pawl 106*a*' is separate, but the comb structure 108' extends behind the pawl 106*a*', as best seen in FIG. 10B, and acts as a stop to prevent the other pawls from moving inward of pawl 106*a*'. Comb 108' also serves as pressure means under the urging spring 118 to keep drive pawl 106*a*' always in contact with its ratchet wheel 76*a*', so that the pawls act on the ratchet wheels exactly in the same way that they did in connection with the structure of FIG. 5. For example, when pawl 106*a*' reaches notch 132' in ratchet wheel 76*a*', pawl 106*a*' is urged further in toward the ratchet wheels by spring 118' so that pawl 106*b*' is able to engage and drive ratchet wheel 76*b*'. An important difference in the action from that of FIG. 5 is that beneath the unitary comb structure 108' are spring means 140 which are relatively light and easily compressible and which are compressed once one of the pawls in comb 108' contacts a tooth of its associated ratchet wheel. Slots 142 in each of the drive pawls 106*b*' through 106*h*' accommodate the downward movement of these pawls connected to the comb 108' relative to the shaft 110', which is fixed in its location relative to housing 112'. In addition, the index position of ratchet wheel 76*a*' is advanced a little ahead of the index position of all other ratchet wheels 76*b*' through 76*h*'. The index position of each ratchet wheel is determined, for example, by the position of its indexing pawl, corresponding to indexing pawls 120 (FIGS. 4 and 5). With pawl 106*a*' engaging notch 132*a*' from its lowermost position, as the arm 114' moves upward with pawls 106*a*' and 106*b*' urged into the ratchet wheels 76*a*' and 76*b*', pawl 106*b*' cannot engage a tooth to drive rotationally displaced ratchet wheel 76*b*' until it reaches the first dash line position of pawl 106*b*' after a predetermined distance, say two-thirds of the distance between teeth. After engagement of ratchet wheel 76*b*' in this example, pawl 106*b*' must compress springs 140 before moving its associated ratchet wheel 76*b*' during which time pawl 106*a*' moves ratchet wheel 76*a*' the balance of one full step to the first dash line position of pawl 106*a*'. Therefore, during the time ratchet wheel 76*a*' moves a full unit of movement, the ratchet wheels 76*b*' through 76*h*' have not been able to move. As drive continues, ratchet wheel 76*a*' moves an additional full unit of movement while at the same time ratchet wheel 76*b*' moves the same one unit during the second unit of movement of ratchet wheel 76*a*' as seen in the second dash line position. After drive is accomplished, each indexing pawl holds its ratchet wheel while the drive pawls are retracted to their original full line position. Thus, retention pawl 120*a*' retains ratchet wheel 76*a*' indexed in the position shown in FIG. 11**, somewhat advanced over the common index positions of the other ratchet wheels.

Figure 12A:
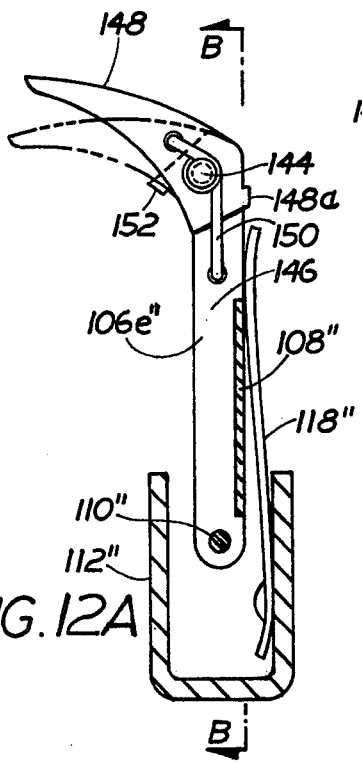
FIG. 12A is a side view showing a modified pawl arrangement serving the same purpose as some of the structures of FIGS. 10A, 10B and 10C.
Figure 12B:
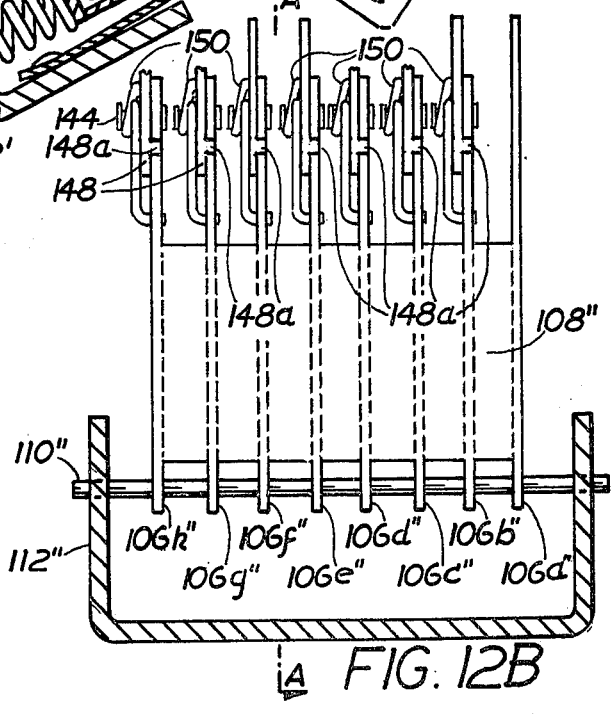
FIG. 12B is a sectional view taken along line B—B of FIG. 12A.

The same results can be achieved with other drive pawl structures. For example, the modified pawl structure of FIGS. 12A and 12B provides an example wherein all of the pawls **106*a*" through 106*h*" are pivotally supported on rod 110" which, in turn, is supported on pawl housing 112". The arrangement of ratchet wheels would be like that shown in FIG. 11 with the ratchet wheel 76*a*" indexed somewhat in advance of the other ratchet wheels. As in FIGS. 10A–10C version, pawl 106*a*" immediately begins driving its ratchet wheel 76*a*". Each of the other pawls, however, cannot engage a tooth of their ratchet wheels for some distance. A modified lost motion device, best seen in FIG. 12A in connection with pawl 106*e*", further delays the drive of any other drive pawls 106*b*" through 106*h*" as described above in connection with FIG. 11**.

The pawls are of two piece construction, including an interconnecting extension element 146 and a ratchet tooth engaging member 148, pivotally connected together by pin 144. The pin 144 also serves as a post around which spring 150 is wrapped. The ends of the spring are inserted into holes in pieces 146 and 148. All of the extension pieces 146 are connected in a comb back 108" which, in this instance, may also be attached to pawl **106*a*" as well, since the lost motion is in the individual ratchet tooth engaging members 148 above the comb. A tab 152 is preferably formed as an integral part of extension element 146 and is designed to act as a stop for tooth engaging member 148 in its dash line position to prevent movement beyond the position shown. Tab shoulder 148*a* on tooth engaging member 148 engages extension element 146 in the solid line position of member 148**. The stops limit movement of the tooth engaging element between these two positions shown. Of course, both stops are preferably properly heat treated and hardened.

The pawls are urged by spring 118" which bears against the comb structure 108" to urge them against their respective ratchet wheels. Again, the pawls **106*a*" through 106*h*" decrease in length and under the urging of spring 118" act exactly in the same way from the standpoint of drive teeth contacting notches 132 in the respective ratchet wheels. However, when a pawl 106*b*" through 106*h*" does contact a tooth or the notch 132 of its ratchet wheel, it is initially deflected from the solid line position to the dashed line position shown in FIG. 12A. Spring 150 is a relatively light return spring which normally urges pawl member 148 into its full line position with its tab stop 148*a* against member 146. Spring 150 yields easily under pressure until stop 152 is engaged in the dashed line position and prevents further movement of pawl member 148 relative to member 146. Thereafter, the pawl element 148** engages with the ratchet wheel to drive its ratchet wheel.

Figure 13:
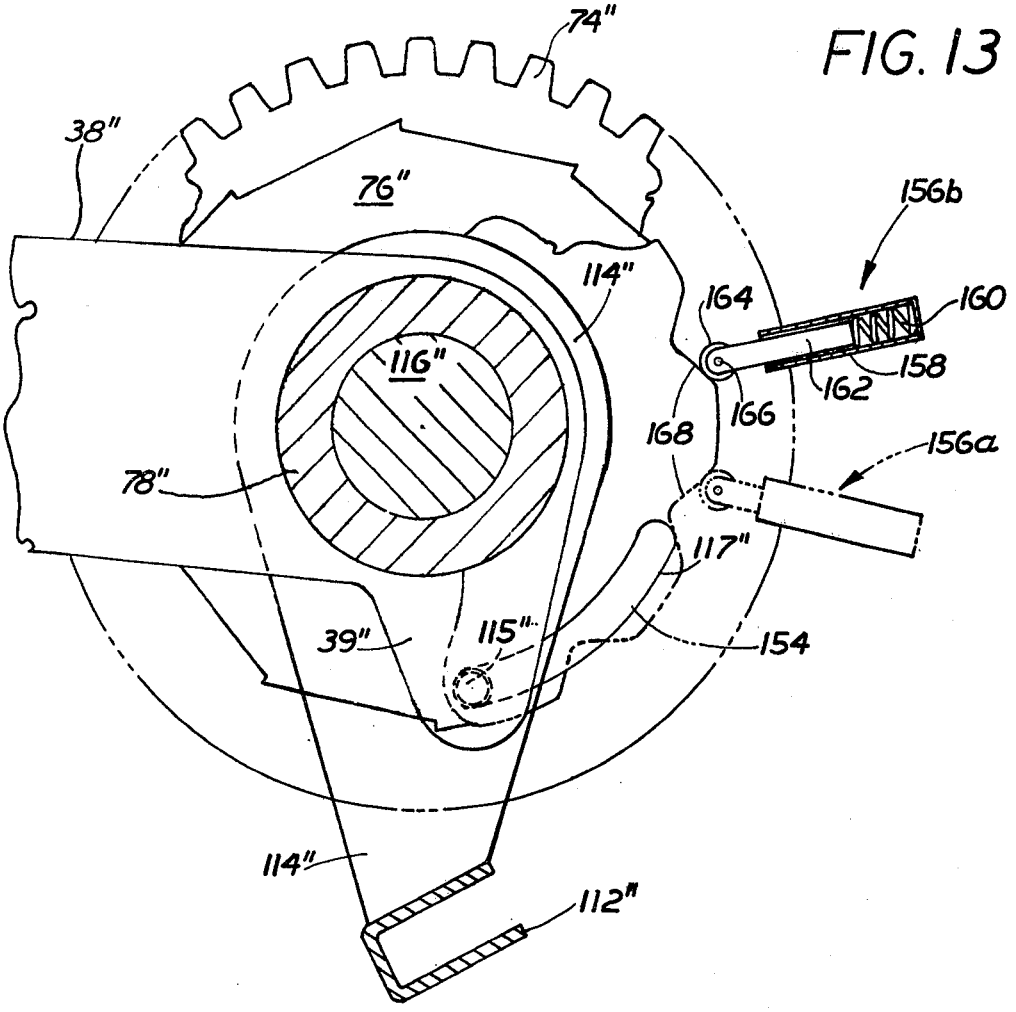
FIG. 13 is a detailed schematic view of a modified indexing or detent device for use in combination with a similar drive.

FIG. 13 shows a modified form of structure in which the indexing function is performed by a detent member rather than an indexing pawl 120 as seen in FIG. 5. The ratchet wheel and gear structure is much like that seen in FIG. 11 including having the units ratchet wheel offset from the others in their indexed positions. However, FIG. 13 shows a three-piece drive structure in which the gear 74'', or other appropriate drive member, is fixed to the coaxial ratchet wheel 76'' and to coaxial detent wheel 154. All three of these elements are mechanically fixed together, or made as one piece so that they mechanically rotate together on the fixed hollow shaft 78''. The functions of all the parts and particularly gear 74'' and ratchet 76'' remain unchanged from previous descriptions. But the indexing wheel and cooperating detent functionally replace the indexing detent of FIGS. 4 and 5. Specifically the indexing wheel 154 is intended to cooperate with a detent element 156. In the simple embodiment shown, the detent element **156*b* is shown sectioned and includes cylindrical cup housing 158, which is fixed in some manner to the frame having a helical compression spring 160 extending from its bottom into a piston element 162 which it urges out of the cup and into the indexing wheel. At its outer end, the piston element 162 carries a roller 164 rotatably attached by pin 166 which is intended to engage and roll upon the undulating outer periphery of indexing wheel 154**.

With this type of indexing system, as will be explained below, a units digit skip feature can be built into the system. Therefore, the skip number pawl arrangements of FIGS. 10A, 10B and 10C or FIGS. 12A and 12B need not be used. Instead the indexing wheels are positoned, as will be described, to correct positions.

In one preferred arrangement, the indexing wheels all have the same orientation relative to their ratchet wheels 76'', which means that the indexing wheel with ratchet wheel **76*a*'' is slightly offset rotationally from the others. The indexing wheel for any ratchet wheels which are pawl driven will tend to be driven to the positon shown at the furthest limit of the drive pawl movement. It should be understood that the simple drive pawl arrangement of FIG. 5 is used under these circumstances, but the offsetting of ratchet wheel 76*a*'' from the others is such that even if others are to be driven by drive pawls, the wheel 76*a*'' will be contacted first and driven some distance before other pawls can engage a tooth of other ratchet wheels. When the drive pawls are withdrawn, the detent roller 164 which is always urged inwardly against the indexing wheel, will tend to move the indexing wheel so that the roller 164 runs "down" the sloping surface and comes to rest on the bottom of the relatively shallow V-trough 168 in a positively stable index position. In preferred decimal type systems, there are preferably ten such troughs 168 per index wheel. Each index wheel is positioned to be moved by its cooperative detent means to one of its ten preselected discrete indexing positions for the drive member 74 and its driven belt. Each drive element 74*a*'' through 74*h*'', corresponding ratchet wheels and indexing wheels 154*a* through 154*h* are made in the same way. But as shown in FIG. 11, the ratchet wheels 76*b*'' through 76*h*'' are slightly offset from the ratchet wheel 154*a*. In order to make the indexing occur at the proper preselected positions, the detent elements 156*b*–156*h* have to be positioned somewhat differently from detent element 156*a*. Alternatively, the detents may be placed in corresponding locations and indexing wheel 154*a* rotated in its position relative to its ratchet wheel and the other indexing wheels. In the embodiment shown, a satisfactory location for detents 156*a* and 156*b* relative to their stopping position for their aligned indexing wheels is illustrated. It will be observed that the stopping position relative to most detents represented by 156*b* is such that its roller 164 lies on the slope of a V-shaped groove 168 which will drive detent wheel 154 clockwise or opposite the direction of its pawl driven movement, as the detent roller 164 seeks the lowest point of the V-groove, corresponding to the selected indexing position. All other detent wheels 154*b* through 154*h* will be driven in the opposite direction from detent wheel 154*a* to assume a final indexed position. Thus, as seen, detent 156*a*** is positioned to drive its detent wheel further in the same direction as the pawl drive. The net effect is that the units digit belt is moved two discrete positions whereas any other belt is driven only one.

It will be appreciated that in order situations where the ratchet wheels are aligned the detent arrangement can still be used with the detents placed to cause indexing in the proper positions possibly necessitating indexing wheel redesign. Whether in such modified form, or in the form shown, the positions of the detents, while critical, is not unique and they can be moved on the structure to any one of ten points which is convenient around the periphery of the indexing wheel 154.

Figure 14:
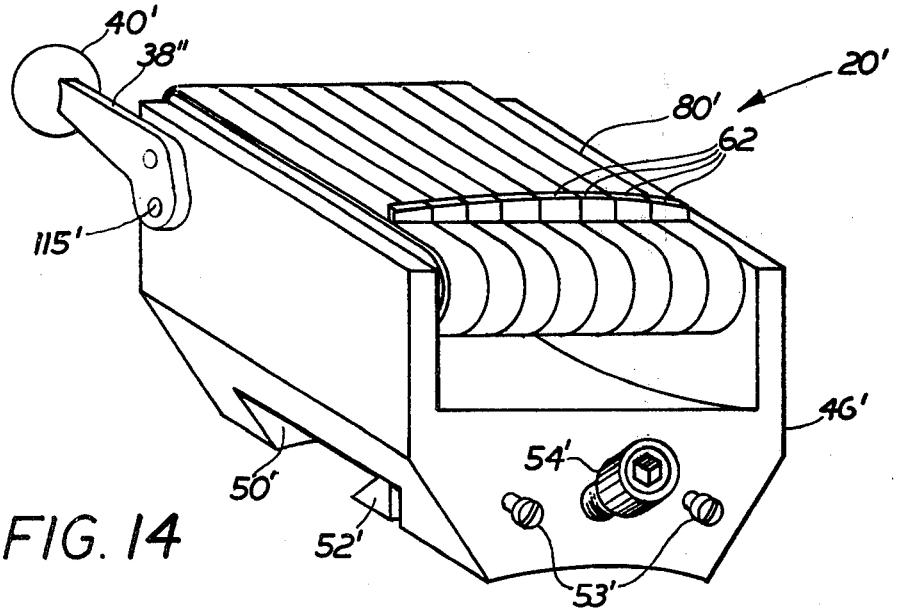
FIG. 14 is a perspective view of a modified encoding printing device for printing a matrix at right angles to the matrix of the device of FIG. 2.

FIG. 14 shows a modified form of encoding printing device in which much of the operating structure remains essentially the same but in which the frame is attached to the number shaft (see FIG. 1) at right angles to the orientation of the frame of the structure of FIGS. 1–4, for example. The direction of rotation and of printing is transverse to the direction of the previous encoding printing device of FIGS. 1–4. To accomplish this purpose, the encoding printing device frame 20' has its dovetail groove 50'oriented at right angles relative to that shown, for example, in FIG. 2. The operator arm 38'', however, preferably retains its relative position with respect to the rest of the encoding printing device, and can no longer conveniently employ a roller structure similar to roller 40. The modified device of FIG. 14 substitutes a ball 40' as a follower in cam groove 42' which acts to move the arm 38'' and activate the drive structure exactly as in other versions described.

In this arrangement the printing head 80'', instead of being curved in conformance with the radius of revolution on the press (see FIG. 1), is preferably made flat as seen in FIG. 9. This is preferred because the necessary curvature to conform to the radius of revolution is at right angles to the belts in the direction of their extension, and it is difficult to provide proper curvature to the belts without also providing a twisting action, which is undesirable. Instead it is preferred in accordance with the invention to use raised printing elements 62'' of different length in order to conform to the required curvature across the belts as shown in FIG. 14. FIG. 9 shows a flat printing head 80' intended for use with encoding printing device of the type shown in FIG. 14 and the belt shown carries a print element 134 appropriate to this embodiment.

The pattern of printing of the encoding printing device of FIG. 14 will, of course, be also turned at right angles to the printing of the structure of FIGS. 2 through 4. This is best understood by reference to FIG. 15 which illustrates a code grid layout on a form sheet and shows alternative directions of movement of the form through the press. The type of encoding printing device and head employed will depend upon the direction of movement through the press, but the end results will be the same from the standpoint of the pattern printed. The code grid, of course, may not appear on the form as shown, and may have any other desired outline or may have no outline at all. In the particular form shown, the code grid 170 appears approximately twice the size it would appear in actual use. It will be understood that in use marks may be made by hand, the printing encoding device of the present invention or any other type of printing encoding device. When a printing encoding device is employed, it will be understood that code mark location relative to a sheet 172 is critical in the machine reading process and a code grid is necessarily located to define proper registration of the actual marks on the sheet. Only the rectangular slot positions below the numbers printed in the code grid represent character print locations in this particular example. With the bar type of print elements described, the coding will be in terms of series of bars, one in each column, 174*a*, 174*b*, 174*c*, 174*d*, 174*e*, 174*f*, 174*g*, and 174*h*, defining respectively units, tens, hundreds, thousands, ten thousands, hundred thousands, millions, and ten millions decimal places. Different row locations 180, 181, 182, 183, 184, 185, 186, 187, 188, and 189 indicate respectively the digits 0, 1, 2, 3, 4, 5, 6, 7, 8, and 9. It will also be appreciated that in addition to permitting columns for the bars to be placed immediately adjacent to one another, the row spacing of adjacent bars can be even closer together than indicated, but the showing is intended to represent a typical grid. The sheet itself can be of any size and the code pattern location can be any preselected place thereon. The grid is desirable where visual inspection and determination of the coded number may be required.

Figure 15:
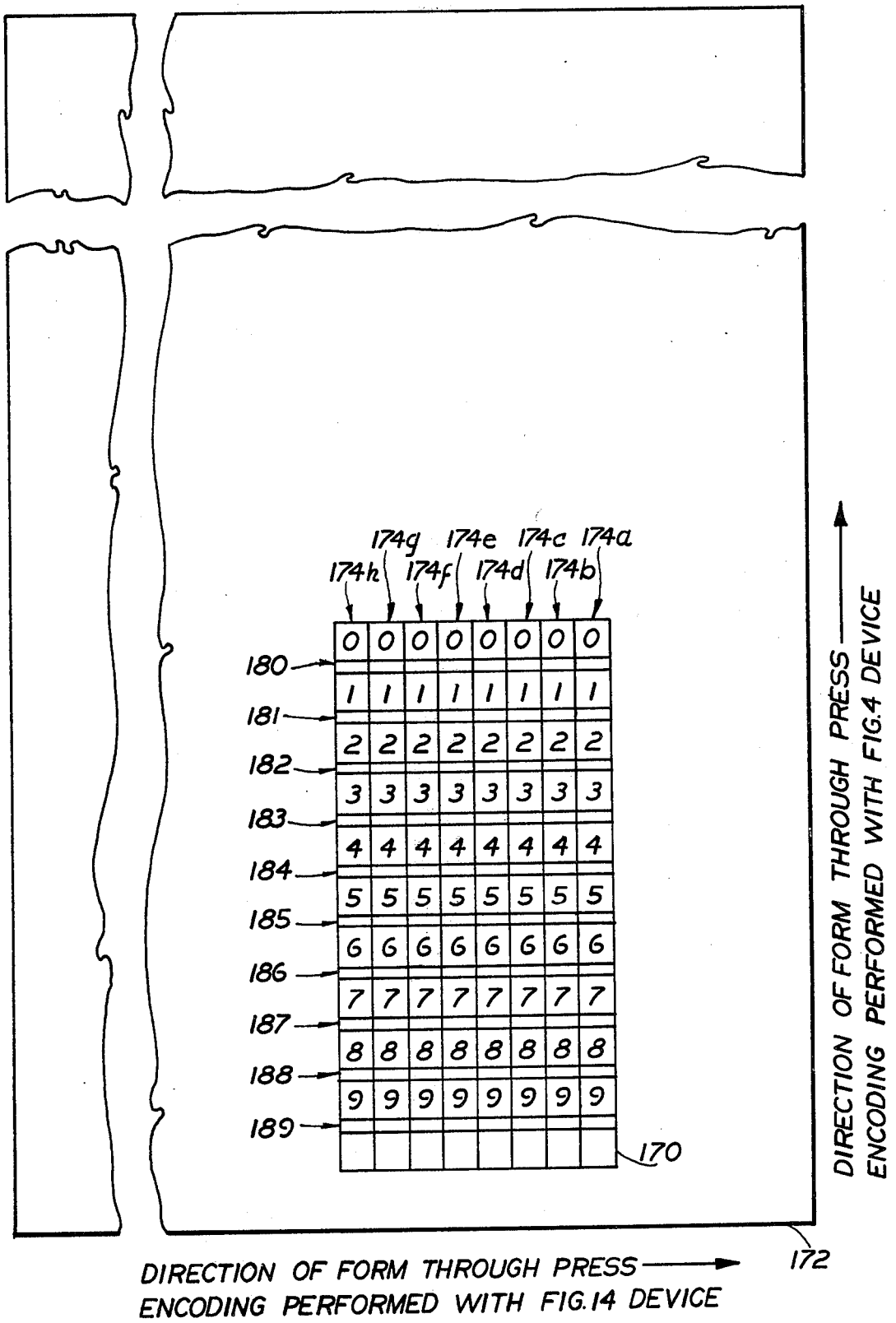
FIG. 15 is an illustration of a machine readable code matrix frame pattern relative to which code is printed by bar type printing elements of an encoding printing device of the present invention.

FIG. 15 by its legend shows the direction of the form through the press for use with each of the devices of FIG. 4 and FIG. 14, respectively. No matter which device is used, the same code can be imprinted and it can be arranged to be imprinted within the spaces provided in the code grid 170, for example. This kind of code printing can be done with the prior art encoding printing devices but is preferably done with the device of the present invention or some other device permitting the printing of a total matrix, which has not been possible in accordance with the prior art. Although such devices are not to be preferred, it is also conceivable that other mechanical devices may be advised to print in matrix form in accordance with the method of the present invention. The method is broadly a method of distinguishing and identifying sequentially printed documents which involves arranging mark printing element in parallel columns so that marks in various rows permit printing a matrix of marks capable of being read by a mark reader. Then in accordance with the method, the positions of the marked printing elements are changed in successive steps so that the successive printings will present different patterns of marks in the matrix. Thus, encoding printing devices of the types described are not the only possible devices included within the present invention which could also include devices in which the print element is not on a belt but on some sort of a slide movable in a slot representing a column. It could also apply to structures in which the print elements are moved back the direction they were moved originally once the end of the column is achieved rather than being moved around a continuous path in the same direction. Other arrangements within the scope of the method will be apparent to those skilled in the art and are intended to be within the scope and spirit of the claims appended hereto. The method includes a random patterning and it also includes an orderly type of pattern such as that described above in which successive documents are identified by movement of one mark one place in a given column, preferably in which, when the mark reaches the end of one column, a step is taken in another column, preferably the adjacent column. Preferably the movements in each column begin at a designated top in a column, and, when mark movement through that column is finished, a mark moves another position away from the top in an adjacent column and the mark in the first column is then started from the top and passes back through the same column again.

Of course, the preferred arrangement is one in which unit changes are represented by an end column preferably printing out as a righthand column and columns successively to the left represent the next decimal place corresponding exactly to their sequence in the number represented. Preferably there is a carryover function in connection with the method so that as marks reach the end of a given column, the carryover mechanism is effective to cause the mark to begin in that column again and a mark to move one place in the column representing the next higher decimal position. Preferably, the system is representative directly of a decimal system, but it will be understood that other numerical forms of coding can be employed and may be desirable in certain applications including codes that employ more or less than ten discrete print element positions per column, different numbers of print element positions in different columns, non-sequential positioning of print elements in the discrete positions provided and any of the other possible combinations and permutations possible with mark location.

It is also possible to use marks other than bar marks. Other symbols may be used as desired in a given application.

It will be appreciated by those skilled in the art that in addition to the sequential drive of the belt means and other forms of mechanical movement of the belts in the encoding printing device of the present invention, it is possible to build such a device wherein the belts are manually positioned. Manual positioning may be done either by use of thumb wheels, or the like, or, where keeping the belts extremely close together is important, the manipulation might be of the belt itself. The ratchet wheel may be completely replaced by a thumb wheel, or eliminated entirely since it is not needed to drive that particular belt. However, it is necessary to supply some sort of indexing means, which could well be an indexing means similar to indexing wheel 154 in FIG. 13 in cooperation with a detent structure like 156. Of course, under these circumstances, the indexing wheel would preferably have no "flat" areas between the indexing points, and the specific indexing points might even be more distinct valleys or grooves to provide a little more positive engagement of the detent. However, an indexing means exactly like wheel 154 in FIG. 13 could be used, and would be operational for this purpose, since the operator could feel when the detent was engaged at each discrete indexing position.

It is unlikely that where manual adjustment of the belts is employed it would be employed for all of the belts of a given encoding printing device. In fact, in a device of the type shown where eight belts are employed, it might well be that two of these were manual positioned. The two might well be at either edge of the structure but preferably would be two which would print out in the left most columns of the matrix as pictured in FIG. 15. These two belts might be used to print information identifying the user or distributor of the forms by a fixed code which would not change over a total printing of that form.

It is also conceivable that only a single belt might be used in a given case to permit printing of marks in different places in a single column rather than having a matrix of mark positions. Additional variations in belts and in drives for the belts are also possible with the gear-like means shown, for example, in FIGS. 11 and 13 and the sprocket wheels suggested for use as a chain drive with the belt structure of FIG. 8, being preferred. Many other variations in drive structure would be possible. It will be appreciated by those skilled in the art that the apparatus shown is meant to be merely representative of possible structures. In many cases, the structures shown are somewhat schematic or illustrate a structure which for specific practical applications is subject to improvement. Certainly other equivalent practical expedients well known in the art may be employed. Representative means of accomplishing various functions required within a device of the present invention have been shown, but in many cases other means will be found and will prove satisfactory in practical applications. All such modifications, variations and changes in the encoding printing device within the scope of the claims are intended to be within the scope and spirit of the present invention. Similarly, variations in the method are to be expected and all variations within the scope of the claims are intended to be within the scope and spirit of the present invention.

I claim:

1. An encoding printing device for printing in sequence related but different machine readable matrix patterns of indicia in association with appropriate printing apparatus comprising:

a support frame attachable to printing apparatus, a plurality of continuous flexible belts arranged side-by-side relative to the support frame, each belt providing on its outside surface at least one print element capable of producing a printed mark and drive engagable means accessible from inside the belt, a printing head on the support frame within the belts providing support for all of the belts over a predetermined multiple row matrix printing area in opposition to printing pressures on the respective print elements during printing and engaging the respective belts within that area to provide guides to maintain the respective belts and their print elements in predetermined column locations so that each belt path over said area defines a column, and individual drive and indexing means for each belt supported on the frame and engaging the drive engagable means of its associated belt to move said belt around the closed path defined by the belt and bounded at least in part by the respective printing head guides and providing a plurality of corresponding discrete row index positions for each at least one print element on its associated belt, whereby each belt is enabled to be stopped in successive ones of selected index positions to position its at least one print element in any selected one of the rows and relative to print elements on the other belts similarly selectively positioned within the predetermined matrix printing area.

2. The encoding printing device of claim 1 in which the drive means include axially symmetrical drive elements coaxially aligned along and rotatable about their axis of symmetry engaged with the drive engagable means of their associated belts to move the belts along their belt paths.

3. The encoding printing device of claim 2 in which the drive and indexing means include distinct parts and in which the drive portion of the drive and indexing means is a gear cooperating with a rack as a drive engagable means inside each belt and the indexing portion of the drive and indexing means cooperates with the drive means to permit each belt to stop only in predetermined discrete positions.

4. The encoding printing device of claim 2 in which each belt is provided with a plurality of path-defining guide means, corresponding guide means being aligned in side-by-side positions on the support frame, which guide means, with the printing head and drive means, define path shape and support said belts generally parallel to and adjacent to one another.

5. The encoding printing device of claim 4 in which each flexible belt is a chain composed of a repetitive pattern of link segments at least one of which carries an outwardly extending print element, the links being connected together by even spaced similar coupling means.

6. The encoding printing device of claim 5 in which the printing head provides guides in the form of parallel guide channels which receive the belts and opposed retention rails which project inwardly toward one another from the side wall of guide channels.

7. The encoding printing device of claim 1 in which the continuous flexible belts are each formed of resilient material of essentially uniform cross-section throughout their length.

8. The encoding printing device of claim 7 in which the belts are composed of molded resinous organic material.

9. The encoding printing device of claim 7 in which the belts are formed of flexible metallic material.

10. The encoding printing device of claim 9 in which the belts are strips of flexible metal having uniformly shaped and evenly spaced drive holes punched through the strips at uniformly spaced distances along the length of the belt.

11. The encoding printing device of claim 7 in which the drive engagable means of the continuous flexible belts include a series of integral inwardly projecting teeth on the inside of the belt engagable with meshing teeth on the cooperating drive means for the purpose of driving the belts and enabling indexing of the belts in selected positions.

12. The encoding printing device of claim 11 in which the teeth of the belts are integral and made of the same material as the rest of the belt.

13. The encoding printing device of claim 7 in which the individual drive engagable means for each belt are uniformly shaped and evenly spaced openings along the belt.

14. The encoding printing device of claim 13 in which the openings are perforations extending through the belt.

15. The encoding printing device of claim 1 in which the printing head portion includes parallel guide channels each of which receives at least a portion of a belt to keep the belts in parallel pathways and their print elements in parallel columns in passing over the printing head.

16. The encoding printing device of claim 1 in which the printing head provides support and guide means for each belt by enclosing at least a portion of the belt within a guide channel having retention rails which extend toward one another from the guide channel walls and overlie the portion of the belt retained within the guide channel.

17. The encoding printing device of claim 16 in which each belt contains at least one print element projecting above the retention rails.

18. The encoding printing device of claim 17 in which each print element extends laterally over the retention rails and is of such width that the print elements in adjacent columns are almost in contact as they pass one another.

19. The encoding printing device of claim 18 in which the print elements are bars running transverse to the length of the belts.

20. The encoding printing device of claim 19 in which each belt is provided with a plurality of print elements so arranged that no more than one print element appears in a printing head column at a given time and following disappearance of one print element another will appear in the column after a predetermined length of the belt and the spacing between print elements is the same on a given belt so that print elements recur on the same basis time after time.

21. The encoding printing device of claim 20 in which there are a preselected number of drive engagable means for each print element on each belt corresponding to a preselected number of discrete row positions for the print element and the index means is associated with the drive means to allow the belts to stop their print elements only in predetermined discrete row positions.

22. An encoding printing device for printing in sequence related but different indica in association with appropriate printing apparatus comprising:

a support frame attachable to printing apparatus, a plurality of continuous flexible belts arranged side-by-side relative to the support frame, each belt providing on its outside surface at least one print element capable of producing a printed mark and drive engagable means accessible from inside the belt, a printing head on the support frame within the belts providing support for all of the belts over a predetermined printing area in opposition to printing pressures on the respective print elements during printing and engaging the respective belts within that area to provide guides to maintain the respective belts and their print elements in predetermined column locations, individual drive means for each belt, including axially symmetrical drive elements coaxially aligned along and rotatable about their axis of symmetry supported on the frame and engaging the drive engagable means of its associated belt so as to permit no relative movement therebetween to move said belt around the closed path by the belt and bounded at least in part by the respective printing head guides, a ratchet wheel mechanically fixed to and rotating with each rotable drive means, a drive pawl cooperating with each ratchet wheel, a mechanism which moves each drive pawl so that, when that drive pawl is moved in a predetermined drive direction against a tooth of a ratchet wheel, the ratchet wheel and the drive means will advance the position of the belt.

23. The encoding printing device of claim 22 in which each ratchet wheel and rotatable drive means also have indexing means which acts relative to the frame to position its associated belt only in one of the discrete predetermined print element row positions.

24. The encoding printing device of claim 23 in which an indexing wheel separate from, coaxial with and mechanically connected to the ratchet wheel is provided for each belt and detent means supported on the frame cooperates with said indexing wheel to position its associated drive means to one of a discrete number of indexing positions corresponding to preselected discrete belt and print element positions.

25. The encoding printing device of claim 24 in which the indexing wheel has an undulating periphery into which detent means is urged including a plurality of unique low points flanked by slopes such that the pawl urges the indexing wheel to assume a position in which the detent lies in the low point.

26. The encoding printing device of claim 25 in which the detent includes a piston carrying a roller contacting the indexing wheel.

27. The encoding printing device of claim 23 in which the indexing means acts upon the same ratchet wheel which is driven by a drive pawl.

28. The encoding printing device of claim 27 in which the indexing means is an indexing pawl arranged to be resiliently urged into the ratchet wheel to reposition the ratchet wheel and its associated drive means in a discrete position corresponding to a discrete print element row position for its associated belt after the drive pawl completes movement of the ratchet wheel.

29. The encoding printing device of claim 28 in which the indexing pawl cooperates with cam means on the ratchet wheel to drive the ratchet wheel back to a predetermined indexing position.

30. The encoding printing device of claim 29 in which the indexing pawl is an element pivotally supported on the frame and resiliently urged against successive cam surfaces on the ratchet wheel to move the ratchet wheel to the adjacent indexing position in which the indexing pawl engages a tooth on the ratchet wheel.

31. The encoding printing device of claim 22 in which the various drive pawls for the respective ratchet wheel drive means are part of a set of pawls which are urged by common means toward their ratchet wheels and are of different lengths so that only one drive pawl is permitted to engage its corresponding ratchet wheel initially and in which each of the ratchet wheels is provided with a notch in its contact surface at least one notch per revolution such that when the longest pawl reaches the notch the pawl will be urged into the notch to permit the next longest pawl in addition to the longest pawl to operatively drive their respective ratchet wheels and each of the successive ratchet wheels is provided with similar notches to permit in succession on the simultaneous occurrence of the notches of the various ratchet wheels at the position where the pawls engage the ratchet wheels so that increasing numbers of the shorter drive pawls will make drive contact with their respective ratchet wheels until all drive pawls simultaneously make contact, the notches being designed to permit drive of its ratchet wheel while being deep enough to permit each associated drive pawl to penetrate as far as necessary to permit all successive drive pawls to engage their repsective ratchet wheels.

32. The encoding printing device of claim 31 in which the pawl elements are made as a unitary mechanical element so that all drive pawls are subject to the same movement at the same time.

33. The encoding printing device of claim 31 in which all pawls except the longest are made as a single mechanical unit and there is provided a lost motion device which enables all pawl elements other than the longest to initially yield after contact and thereby permit the longest to drive its associated ratchet for a longer distance, thereby providing the capability of skipping.

34. The encoding printing device of claim 33 in which the single mechanical unit of each pawl other than the longest is movable relative to the longest pawl and resilient means is provided to urge the pawls of the single mechanical unit into operative position such that upon contact with a tooth of a ratchet wheel the light resilient means will yield and permit the single mechanical unit to move to a position where it bottoms on stop means, following which each engaged pawl will drive its associated ratchet wheel a shorter distance than the longest pawl drives its ratchet wheel.

35. The encoding printing device of claim 34 in which part of the unitary structure mechanically connecting the other pawls together is extended to provide a reference stop against which the longest pawl is pressed, but relative to which it can move and spring means urges the unitary structure and the longest pawl through the stop toward the ratchet wheels.

36. The encoding printing device of claim 35 in which the structure connecting the pawls together is a common back plate forming a comb of the unitary structure, which back plate extends behind the separate longest drive pawl to act as the reference stop, the pawls are pivotally supported on a pawl carriage and the spring means presses against said comb back plate from its support on the pawl carriage.

37. The encoding printing device of claim 33 in which all drive pawls are part of a unitary mechanical structure, and all but the longest drive pawl have movable tip elements which yield upon initial contact with their respective ratchet wheels and drive only after they move into and are stopped in their motion by a mechanical stop.

38. The encoding printing device of claim 37 in which the mechanical structure of the pawls is pivotally supported in a pawl housing with spring means acting between the pawl housing and the mechanical structure to urge the drive pawls toward their respective ratchet wheels.

39. The encoding printing device of claim 38 in which the movable tip elements are pivotally connected to the rest of the pawl structure by a pivot parallel to the pivotal support on the pawl housing, light spring means urges each movable pawl tip into a ratchet wheel contacting position but yields to permit rotation of the movable tip element until it engages stop means limiting relative rotation between the pivotally connected pawl members, after which the tip will drive its engaged ratchet wheel.

40. The encoding printing device of claim 39 in which the light spring means is a wire tension spring wrapped around the pivot connecting the two pieces and connected to different ones of the connected pieces at its respective ends.

41. The encoding printing device of claim 22 in which movable manual means cooperates with at least one of said belts is provided to engage and move some part of the belt to move said belt around the closed path defined by the belt and bounded at least over part of said path by the respective printing head guides.

42. The encoding printing device of claim 41 in which as to each of the belts which is not movable by manual movement there is individual drive and indexing means supported on the frame and engaging the drive engagable means of its associated belt to move it around the closed path defined by the belt and at least in part by the printing head guide and stop the belt at predetermined indexed positions.

43. The encoding printing device of claim 41 in which the means accessible from inside each belt is engaged by axially symmetrical elements coaxially aligned along and rotatable about their axis of symmetry mechanically connected to a coaxial indexing wheel and detent means supported on the frame cooperates with said indexing wheel to position its associated belt to one of a discrete number of indexing positions corresponding to preselected a print element position.

44. The encoding printing device of claim 43 in which the indexing wheel has an undulating periphery including a plurality of unique low points flanked by slopes into which detent means is urged such that the indexing wheel will assume a position in which the detent lies in the low point.

* * * * *